US011254155B1

(12) United States Patent
Cottrell

(10) Patent No.: US 11,254,155 B1
(45) **Date of Patent: *Feb. 22, 2022**

(54) CRAFTWORK TOOLS

(71) Applicant: Concord & 9th LLC, Sarasota Springs, UT (US)

(72) Inventor: Gregory D. Cottrell, Sarasota Springs, UT (US)

(73) Assignee: CONCORD & 9TH, INC, Sandy, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/223,716

(22) Filed: Apr. 6, 2021

Related U.S. Application Data

(63) Continuation of application No. 15/946,792, filed on Apr. 6, 2018, now Pat. No. 11,014,389.

(51) Int. Cl.

| | |
|---|---|
| ***B41K 3/04*** | (2006.01) |
| ***B41K 3/24*** | (2006.01) |
| ***B41K 3/54*** | (2006.01) |
| ***B41K 3/46*** | (2006.01) |

(52) U.S. Cl.
CPC ..... *B41K 3/04* (2013.01); *B41K 3/24* (2013.01); *B41K 3/46* (2013.01); *B41K 3/54* (2013.01)

(58) Field of Classification Search
CPC ... B41K 3/04; B41K 3/24; B41K 3/46; B41K 3/54
See application file for complete search history.

(56) References Cited

U.S. PATENT DOCUMENTS

| | | | | |
|---|---|---|---|---|
| 10,513,135 | B1 * | 12/2019 | Gessner | B41K 3/44 |
| 2001/0016316 | A1 * | 8/2001 | Virtanen | G01N 33/5767 435/6.11 |
| 2005/0257594 | A1 * | 11/2005 | Hutchison | B26D 7/2614 72/482.93 |
| 2007/0022884 | A1 * | 2/2007 | Blau | B41F 31/08 101/217 |
| 2008/0118740 | A1 * | 5/2008 | Kuwahara | B32B 27/06 428/327 |
| 2010/0102043 | A1 * | 4/2010 | Govorkov | B23K 26/361 219/121.69 |
| 2016/0200126 | A1 * | 7/2016 | Myska | B44B 5/0085 101/407.1 |
| 2016/0207302 | A1 * | 7/2016 | Shneider | B41F 17/001 |

* cited by examiner

*Primary Examiner* — David H Banh
(74) *Attorney, Agent, or Firm* — Shane Cortesi

(57) ABSTRACT

Craftwork tools are described. The craftworks tools may include a stamp and a jig with matching alignment patterns. Methods of using same are also described. The method may include placing the jig on a stamp platform, aligning the stamp with the jig, placing cardstock or another substrate on the jig, inking the stamp, and closing the lid of the stamp platform to mark the cardstock with the stamp. The cardstock and the jig may then be rotated clockwise or counterclockwise on the stamp platform without rotating the stamp on the lid, the stamp may be re-inked and then the lid may be closed again to mark the cardstock with the stamp. Methods of using embossing tools are also described.

10 Claims, 19 Drawing Sheets

CRAFTWORK TOOLS

BACKGROUND

Technical Field

The present invention relates to craftwork tools.

Background of the Invention

Stamping platforms generally include a base and a lid pivotably attached to the base. The lid may be configured to pivot toward and away from the base and may include an interior surface configured to accept a stamp. Traditionally, an item of cardstock or other paper substrate is placed on the base with the device open and the lid with attached stamp is brought toward the base to stamp the substrate with ink. Examples of stamp platforms are shown in U.S. Pat. No. 9,597,909, the contents of which are incorporated herein by reference, and commercially available tools on the market include the MISTI (My Sweet Petunia, Inc., Sherrard Ill.), the TONIC TIM HOLTZ Stamp Platform 1707E (Tonic Studios USA Inc., Rippon, Calif.), and the STAMPARATUS (Stampin' Up! Inc., Riverton, Utah).

There is a continuing need to develop tools and methods for use in such devices.

BRIEF SUMMARY

The present disclosure provides craftwork tools as described herein. In some embodiments, the present disclosure provides a method of stamping a stampable substrate comprising the steps of: a) providing a stamp platform comprising a base and a lid pivotably attached to the base and configured to pivot toward and away from the base, the lid comprising an interior surface configured to receive a stamp and the base comprising a workspace configured to support a stampable substrate; b) placing a jig on the workspace, the jig comprising an alignment pattern; c) attaching a stamp comprising an alignment pattern to the interior surface of the lid so that the alignment pattern on the jig aligns with the alignment pattern on the stamp; d) positioning a stampable substrate on the jig; e) inking the stamp with a first color of ink; f) moving the lid and attached stamp towards the workspace and the stampable substrate to mark the stampable substrate with the stamp; g) rotating the stampable substrate and jig on the workspace without rotating the stamp; and h) moving the lid and attached stamp again towards the workspace and the stampable substrate to mark the rotated stampable substrate with the stamp.

Optionally, step g) comprises rotating the stampable substrate and the jig 90 degrees on the workspace without rotating the stamp on the lid. Optionally, the method further comprises, between steps f) and h), cleaning the stamp and then inking the stamp with a different color of ink as compared to step e). Optionally, the stamp platform comprises at least two raised sides bordering and extending above the workspace, and step b) comprises placing the jig against the raised sides. Optionally, the alignment patterns on the jig and on the stamp are x-shaped. Optionally, the stamp further comprises a design pattern, wherein the method further comprises, before step c), providing a guide card comprising a design pattern and an alignment pattern comprising a plurality of intersecting lines, placing the stamp over the guide card so that stamp design pattern aligns with the guide card design pattern, and then drawing the alignment pattern on the stamp. Optionally, the method further comprises drawing the alignment pattern on the stamp prior to step c) with a marker. Optionally, step c) comprises placing the stamp on the jig so that the alignment pattern on the stamp aligns with the alignment pattern on the jig, pivoting the lid towards the workspace, and then pivoting the lid away from the workspace to attach the stamp to the lid. Optionally, the stamp is clear. Optionally, the alignment pattern on the stamp and the jig are each a plurality of intersecting lines. Optionally, the stamp has a lengthwise and widthwise center and the plurality of lines intersect of the stamp at approximately the lengthwise and widthwise center. Optionally, the plurality of intersecting lines are opaque. Optionally, the stampable substrate is a paper-based material. Optionally, the method further comprises, after step h), placing an embossing tool on the stampable substrate and inserting the stampable substrate and the embossing tool through a roller to emboss the stampable substrate. Optionally, the embossing tool has a lengthwise and widthwise center and the embossing tool has a center hole located approximately in the lengthwise and widthwise center.

In still further embodiments, the present disclosure provides a method of stamping a substrate comprising the steps of: a) providing a stamp platform comprising: i) a base comprising a workspace configured to support a stampable substrate, and ii) a lid pivotably attached to the base and configured to pivot toward and away from the base, the lid comprising an interior surface comprising a generally clear stamp removably attached thereto, wherein the stamp is generally clear and comprises a design pattern and an x-shaped alignment pattern formed by opaque lines; b) inking the clear stamp with ink; c) placing a stampable substrate on the workspace; and d) moving the lid toward the base and the stampable substrate to stamp the stampable substrate with ink.

Optionally, the generally clear stamp is a cling mount stamp. Optionally, the method further comprises the steps of, after step d), rotating the stampable substrate on the workspace without rotating the clear cling mount stamp, re-inking the clear stamp with ink, and then moving the lid toward the base to stamp the stampable substrate with ink. Optionally, the stamp has a lengthwise and widthwise center and the x-shaped pattern comprises two lines intersecting at approximately the lengthwise and widthwise center.

In still further embodiments, the present disclosure provides a method of stamping a substrate comprising the steps of: a) providing a stamp comprising ink; b) placing a stampable substrate below the stamp; c) moving the stamp toward the stampable substrate to mark the stampable substrate with ink; d) rotating the stamp relative to the stampable substrate and then moving the stamp toward the stampable substrate to mark the stampable substrate with ink. Optionally, step d) comprises rotating the stamp 90 degrees relative to the stampable substrate, removing the ink from the stamp, re-inking the stamp with a different colored ink as compared to step c) and then moving the stamp toward the stampable substrate to mark the stampable substrate with ink.

BRIEF DESCRIPTION OF THE DRAWINGS

in FIG. 26 the broken lines show how the stamp of FIG. 24 would mark the cardstock if the cardstock was rotated a fourth time 90 degrees.

DETAILED DESCRIPTION

Figure 1:
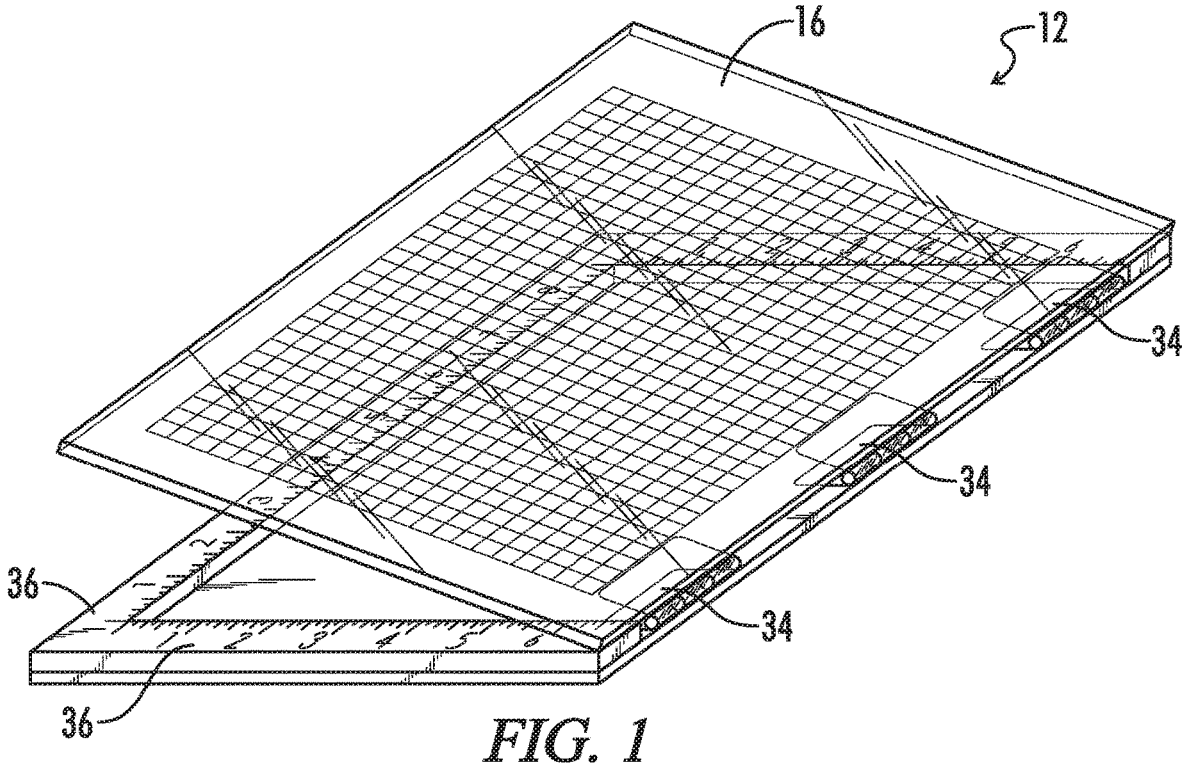
FIG. 1 illustrates a side perspective view of one embodiment of a stamp platform that may be used with the stamps of the present disclosure.
Figure 2:
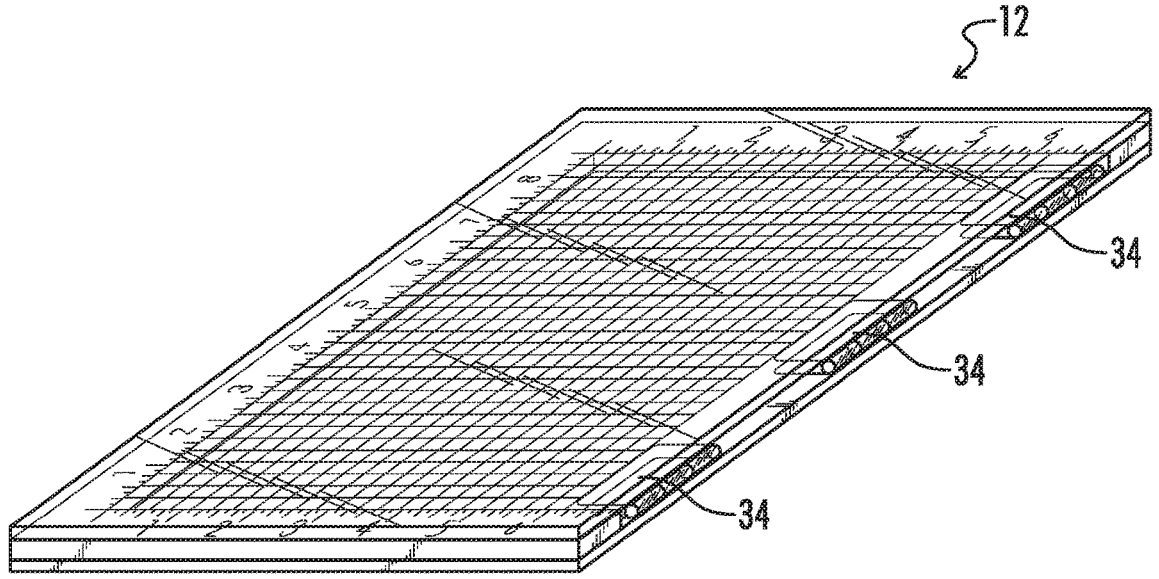
FIG. 2 illustrates a side perspective view of the stamp platform of FIG. 1 with the stamp platform in the closed position.
Figure 3:
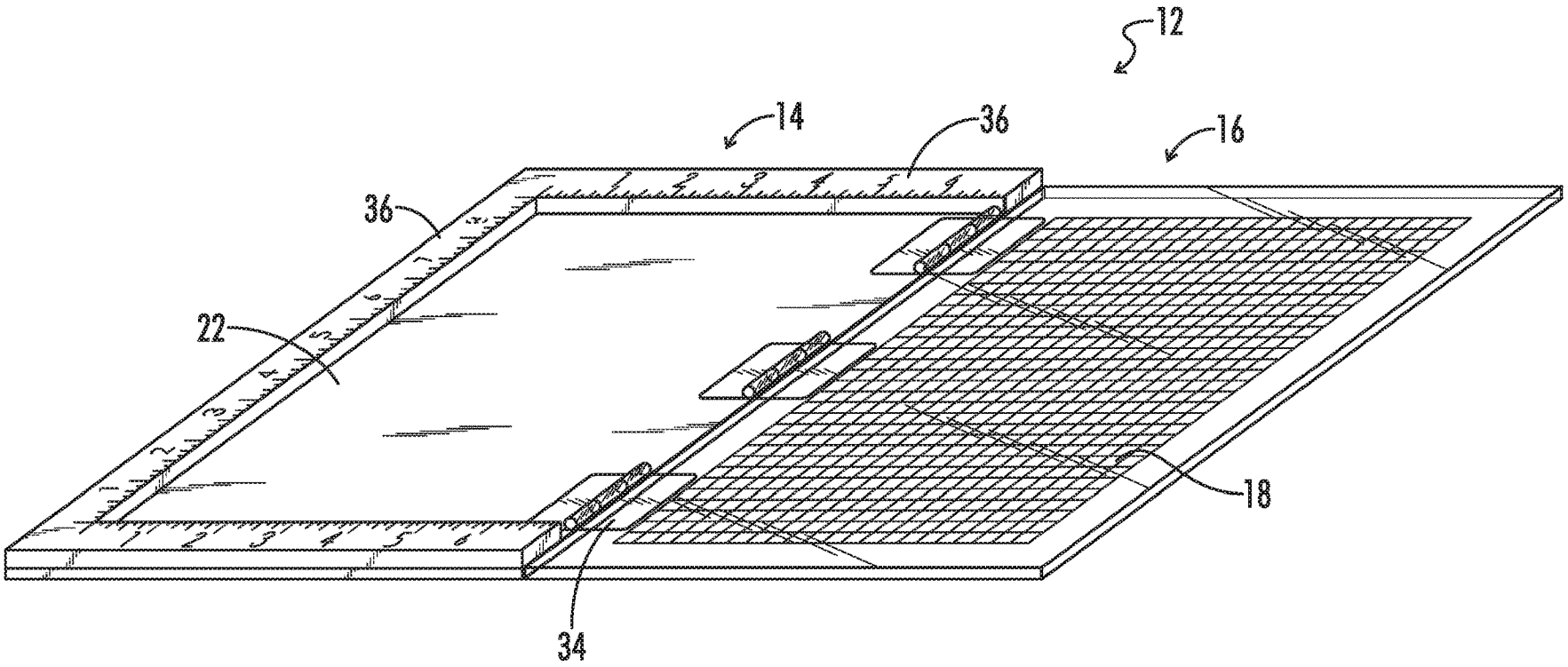
FIG. 3 illustrates a side perspective view of the stamp platform of FIG. 1 with the stamp platform in the open position.
Figure 4:
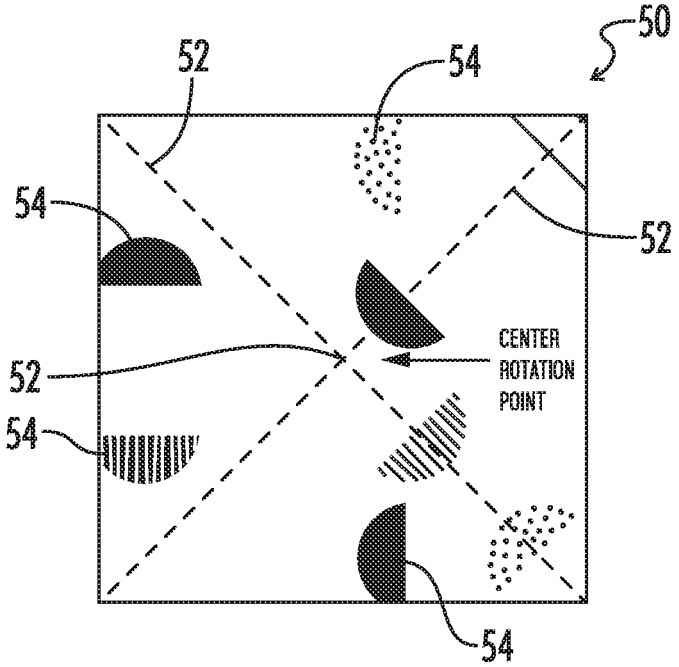
FIG. 4 illustrates a top plan view of a guide card of one embodiment of the present invention.
Figure 5:
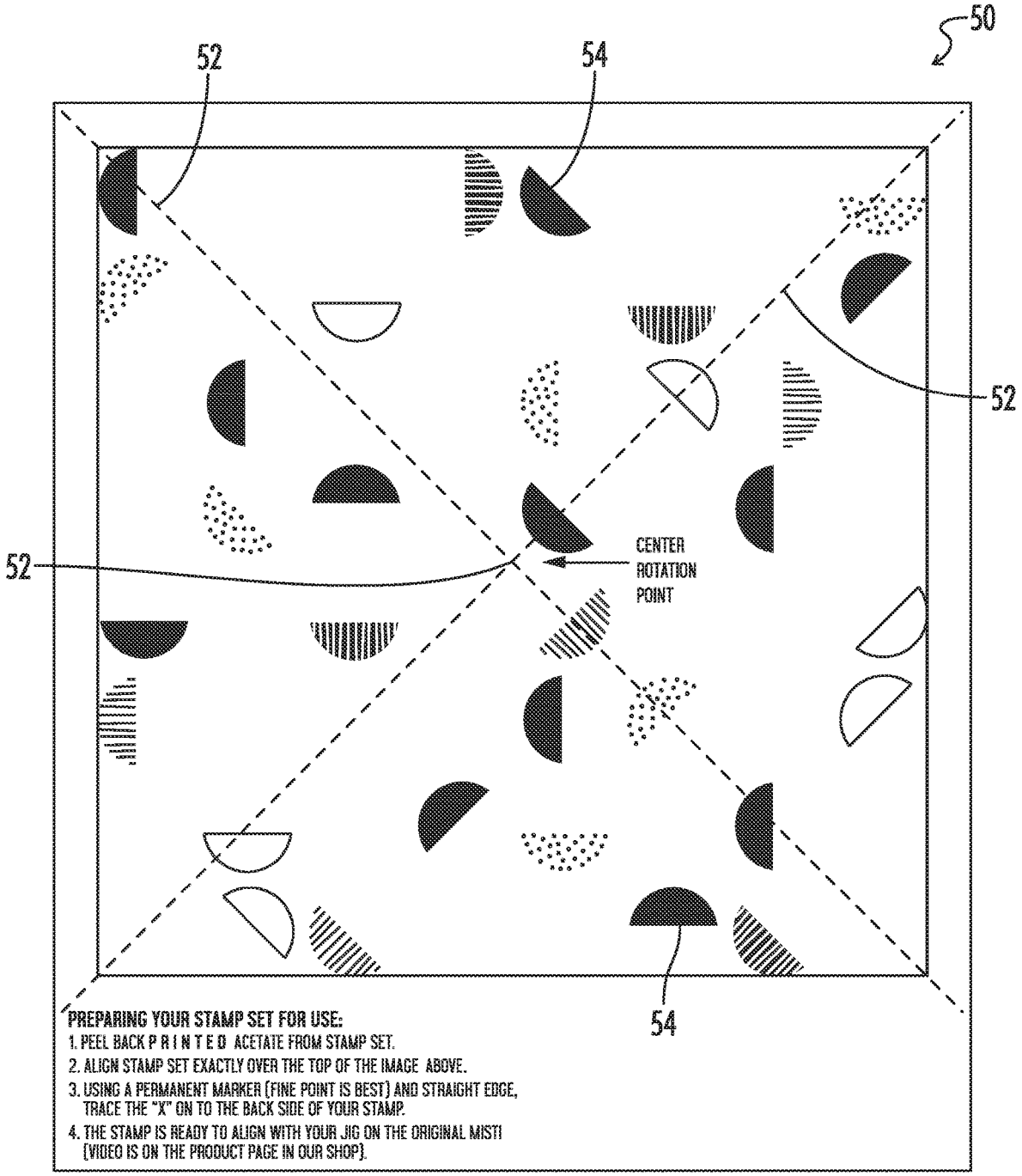
FIG. 5 illustrates a top plan view of a guide card, with instructions on how to use with the MISTI, of another embodiment of the present invention.

With reference to FIGS. 1-38, the present disclosure provides a craftwork tool system. In the drawings, not all reference numbers are included in each drawing for the sake of clarity. In addition, some but not all of the design elements of the design patterns 42 and 54 are labelled for clarity.

Referring further to FIGS. 1-38, in some embodiments, the present disclosure provides a method of stamping a stampable substrate 10 such as cardstock. (Unless otherwise described herein, the steps can be performed in any suitable order). The method may include providing a stamp platform 12 comprising a base 14 and a lid 16. The lid 16 may be pivotably attached to the base 14 and configured to pivot toward and away from the base 14. The lid 16 may comprise an interior surface 18 configured to receive a stamp 20. The base 14 may comprise a workspace 22 configured to support a stampable substrate 10. As noted above, examples of stamp platforms 12 are shown in U.S. Pat. No. 9,597,909, the contents of which are incorporated herein by reference, and commercially available stamp platforms on the market include the MISTI (My Sweet Petunia, Inc., Sherrard Ill.), the TONIC TIM HOLTZ Stamp Platform 1707E (Tonic Studios USA Inc., Rippon, Calif.), and the STAMPARATUS (Stampin' Up! Inc., Riverton, Utah).

Figure 9:
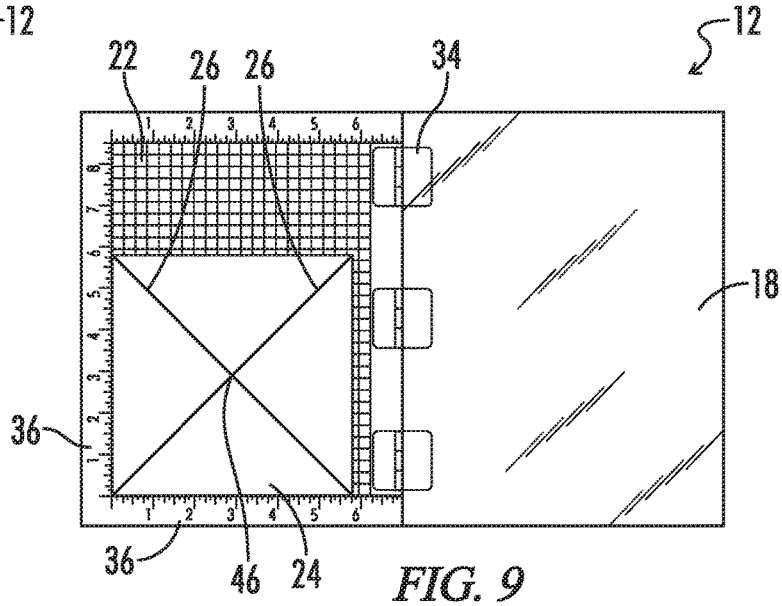
FIG. 9 illustrates a top plan view of the stamp platform of FIG. 1 with the stamp platform in the open position and a jig placed on the workspace.

The method may further include placing a jig 24 on the workspace 22. The jig 24 may comprise an alignment pattern 26 comprising a plurality of intersecting lines. A rectangular jig 24 is shown in FIG. 9 and the alignment pattern 26 is in the form of two intersecting lines in the shape of an X that intersect in the lengthwise and widthwise center 46 of the jig 24. The jig 24 may be made of any suitable material including without limitation cardboard. It will be appreciated that the method used herein may be used without a jig 24, in which case, the user simply rotates the stampable substrate 10. However, a jig 24 is preferably used with the methods herein.

Figure 10:
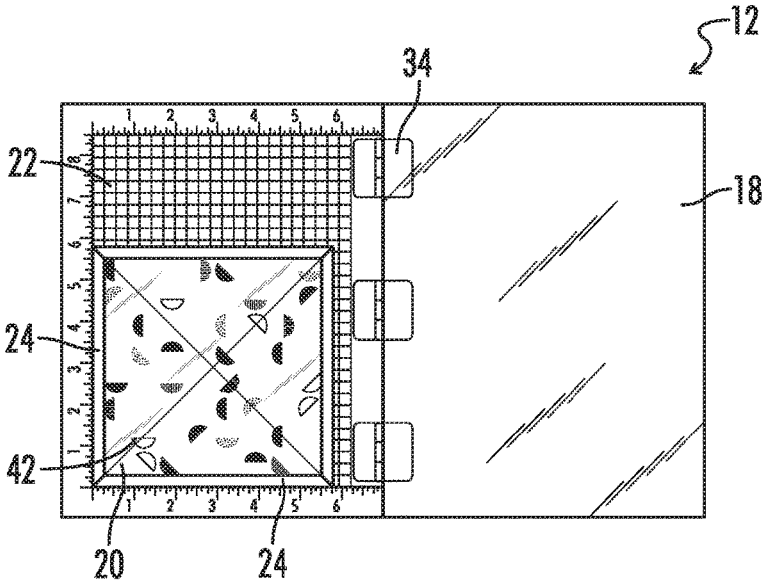
FIG. 10 illustrates a top plan view of the stamp platform of FIG. 9 with the stamp platform in the open position, the jig on the workspace and the stamp of FIG. 6 placed on the jig.

The method may further include attaching a stamp 20, which comprises an alignment pattern 30 comprising a plurality of intersecting lines, to the interior surface 18 of the lid 16 so that the alignment pattern 26 on the jig 24 aligns with the alignment pattern 30 on the stamp 20, as shown in FIG. 10. A rectangular stamp 20 is shown in FIG. 10 and the alignment pattern 30 is in the form of two intersecting lines in the shape of an X that intersect at the lengthwise and widthwise center 44 of the stamp 20. Preferably, the stamp 20 is clear to aid in the alignment of the jig 24 with the stamp 20. The stamp 20 may be any suitable stamp, including without limitation clear cling mount stamps. The stamp 20 is preferably equal to in size, or smaller than the jig 24 (as shown in FIGS. 13, 15, 16, 18, 19, and 20 for example).

The alignment patterns 26 and 30 on the jig 24 and stamp 20 preferably are identical and may be any suitable pattern. In some embodiments, the alignment pattern 30 on the stamp 20 is a dot located in the lengthwise and widthwise center 44 of the stamp 20 and the alignment pattern 26 on the jig 24 is a dot located in the lengthwise and widthwise center 46 of the jig 24. However, the preferred alignment patterns 26 and 30 are an X, as shown in FIGS. 4-5, 7, 8, and 11-21 for example. It will be appreciated that the lengthwise and widthwise center 46 of the jig 24 (and the lengthwise and widthwise center 60 of the substrate 10) are the point about which the jig 24 and stampable substrate 10 rotate.

Figure 13:
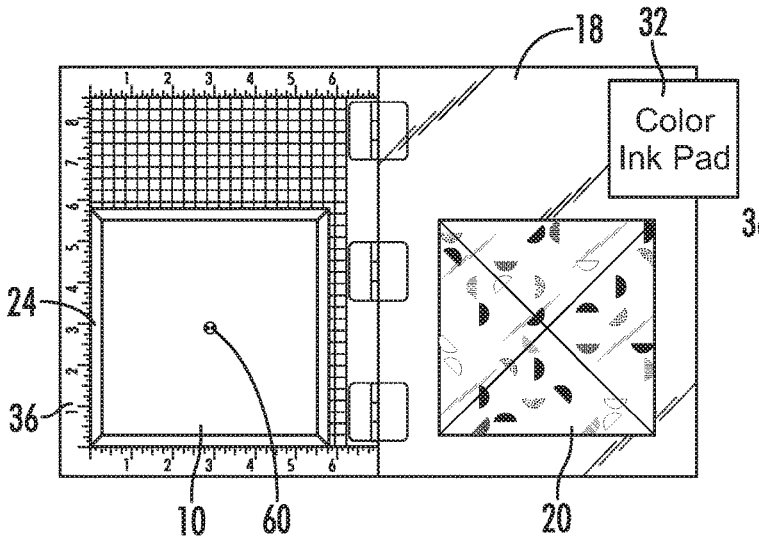
FIG. 13 illustrates a top plan view of the stamp platform of FIG. 12 with the stamp platform in the open position, the jig on the workspace, the stamp of FIG. 12 removably attached to the interior surface of the lid, a first color ink applied to the stamp, and cardstock removably attached to the jig.

The method may further include positioning a stampable substrate 10 on the jig 24, as shown in FIG. 13. Preferably, the stampable substrate 10 is removably attached to the jig 24 using a double sided adhesive adhered to the stampable substrate with a tape runner. However, other attachment mechanisms (preferably temporary attachment mechanisms) may be used. The stampable substrate 10 is preferably a paper-based material such as cardstock.

The method may further include inking the stamp 20 with a first color of ink, as shown in FIG. 13.

Figure 14:
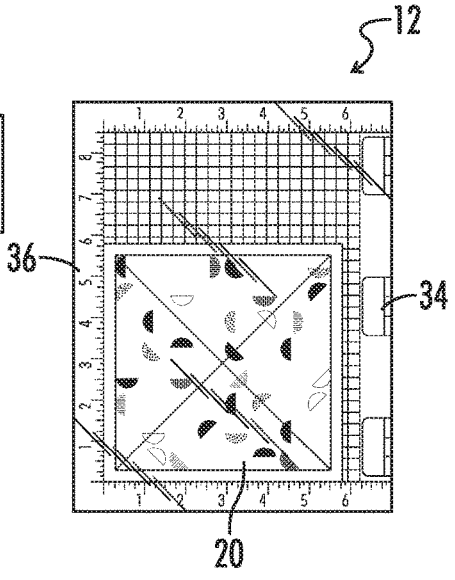
FIG. 14 illustrates a top plan view of the stamp platform, jig, stamp, and cardstock of FIG. 13 with the stamp platform in the closed position.
Figure 15:
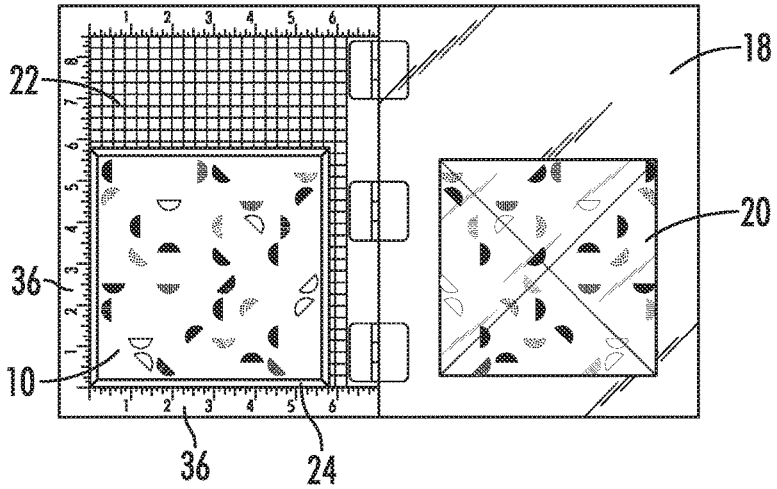
FIG. 15 illustrates a top plan view of the stamp platform, jig, stamp, and cardstock of FIG. 14 with the stamp platform in the open position after the cardstock has been stamped with the first color of ink.

The method may further include moving the lid 16 and attached stamp 20 towards the workspace 22 and stampable substrate 10 to mark the stampable substrate 10 with the stamp 20, as shown in FIG. 14.

Figure 16:
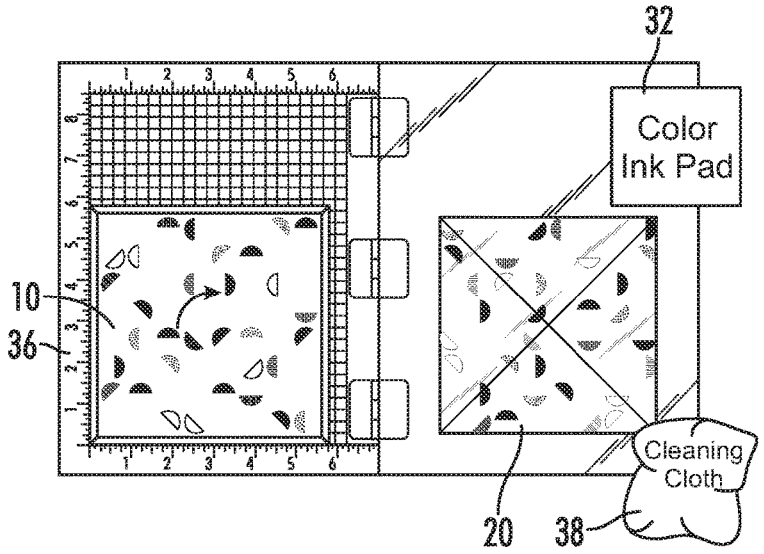
FIG. 16 illustrates a top plan view of the stamp platform, jig, stamp, and cardstock of FIG. 15 with the stamp platform in the open position and a cleaning cloth is being applied to clean the stamp and a second color ink is being applied to the stamp; the directional arrows indicate that the jig and cardstock have been rotated 90 degrees clockwise as compared to FIG. 15.
Figure 17:
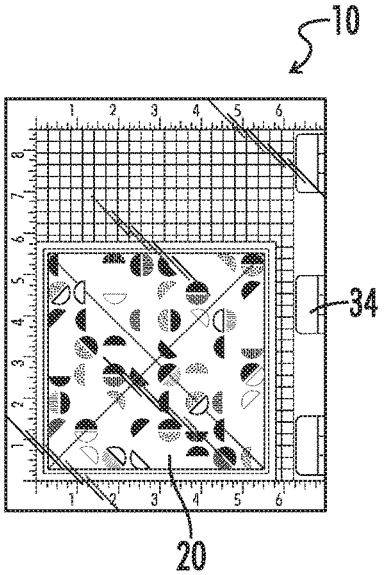
FIG. 17 illustrates a top plan view of the stamp platform, jig, stamp, and cardstock of FIG. 16 with the stamp platform in the closed position.
Figure 18:
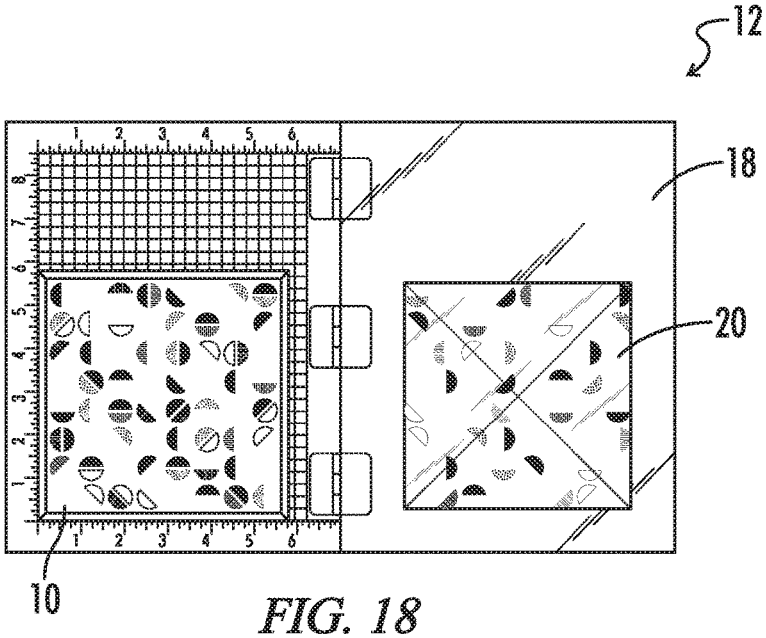
FIG. 18 illustrates a top plan view of the stamp platform, jig, stamp, and cardstock of FIG. 17 with the stamp platform in the open position after the cardstock has been stamped with the second color of ink.
Figure 19:
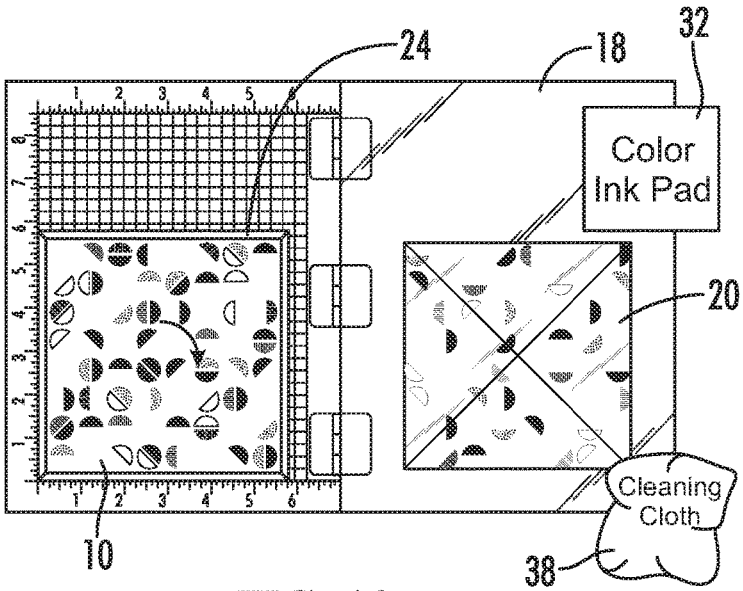
FIG. 19 illustrates a top plan view of the stamp platform, jig, stamp, and cardstock of FIG. 18 with the stamp platform in the open position and a cleaning cloth is being applied to clean the stamp and a third color ink is being applied to the stamp; the directional arrows indicate that the jig and cardstock have been rotated 90 degrees clockwise as compared to FIG. 18.
Figure 20:
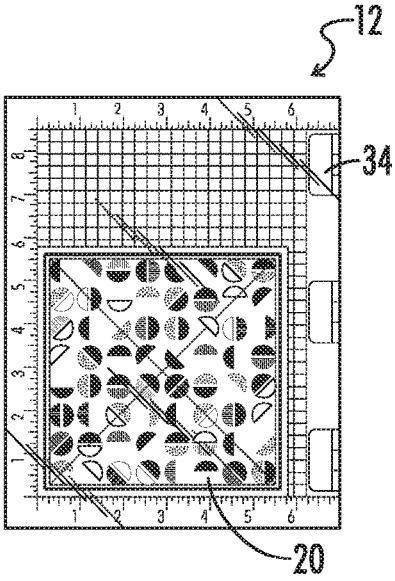
FIG. 20 illustrates a top plan view of the stamp platform, jig, stamp, and cardstock of FIG. 19 with the stamp platform in the closed position.
Figure 21:
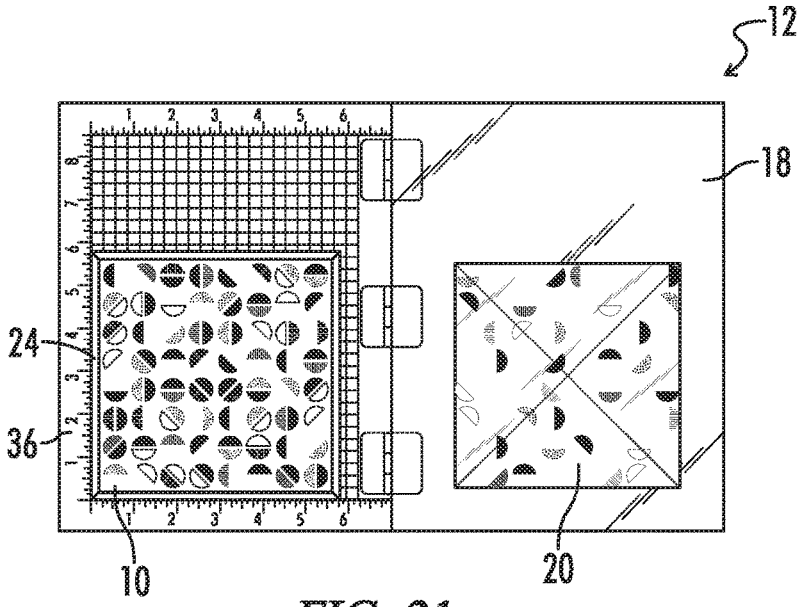
FIG. 21 illustrates a top plan view of the stamp platform, jig, stamp, and cardstock of FIG. 20 with the stamp platform in the open position after the cardstock has been stamped with the third color of ink.
Figure 22:
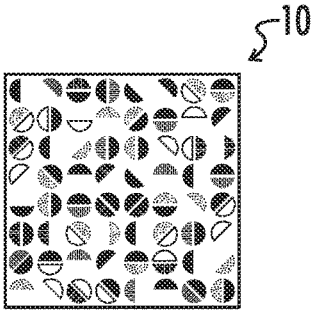
FIG. 22 illustrates a top plan view of the cardstock of FIG. 21.
Figure 23:
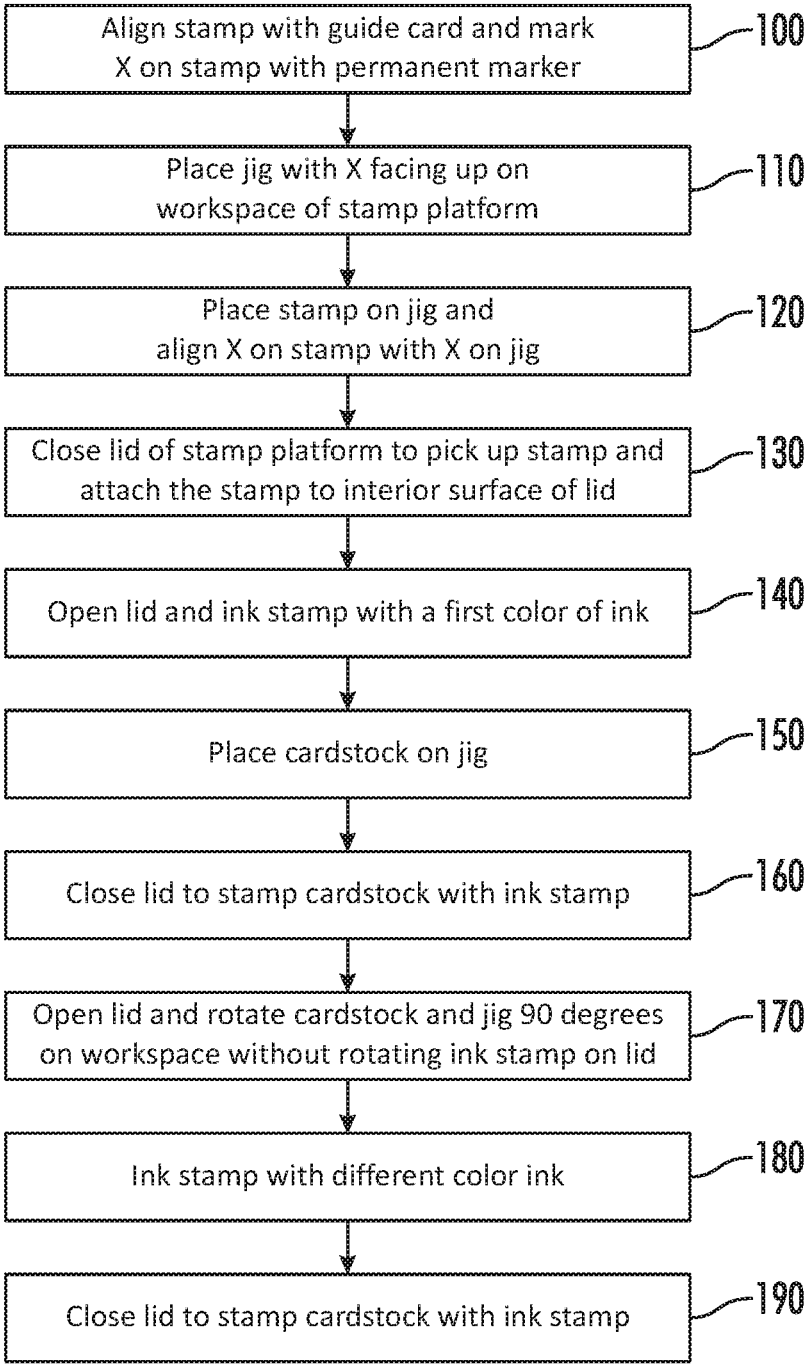
FIG. 23 illustrates a flow chart describing the steps illustrated in FIGS. 7-17.

The method may further include rotating the stampable substrate 10 and jig 24 (e.g., 90 degrees clockwise) on the workspace 22 without rotating the stamp 20 on the lid 16, as shown in FIG. 16, and then moving the lid 16 and attached stamp 20 again towards the workspace 22 and stampable substrate 10 to mark the rotated stampable substrate 10 with the stamp 20, as shown in FIG. 17. The method may further include rotating the stampable substrate 10 and jig 24 (e.g., 90 degrees clockwise) on the workspace 22 without rotating the stamp 20 on the lid 16, as shown in FIG. 19, and then moving the lid 16 and attached stamp 20 towards the workspace 22 to mark the rotated stampable substrate 10 with the stamp 20, as shown in FIG. 20. The method may further include rotating the stampable substrate 10 and jig 24 (e.g., 90 degrees clockwise) on the workspace 22 without rotating the stamp 20 on the lid 16 (not shown) and then moving the lid 16 and attached stamp 20 towards the workspace 22 to mark the rotated stampable substrate 10 with the stamp 20 (not shown). The jig 24 and stampable substrate 10 may be rotated any desired number of times, including three times as described above, or two times as shown in FIGS. 16-19.

Optionally, in the steps shown in FIGS. 16 and 19 in which the jig 24 and stampable substrate 10 are rotated, the method further comprises cleaning the stamp 20 using a cloth 38 and then inking the stamp 20 with a different color of ink so that each rotation marks the stampable substrate 10 with a different color. It will be understood that marking with a different color is optional. An ink pad 32 is shown for simplicity in showing how the stamp 20 is inked. The stamp 20 may be inked by any suitable method.

Optionally, the stamp platform 12 comprises at least two raised sides 36 that are perpendicular to each other and border and extend above the workspace 22, and the jig 24 is placed against the raised sides 36. The stamp platform 12 preferably includes hinge(s) 34 attaching the base 14 to the lid 16.

Optionally, the alignment patterns 26 and 30 on the jig 24 and on the stamp 20 are x-shaped.

Figure 6:
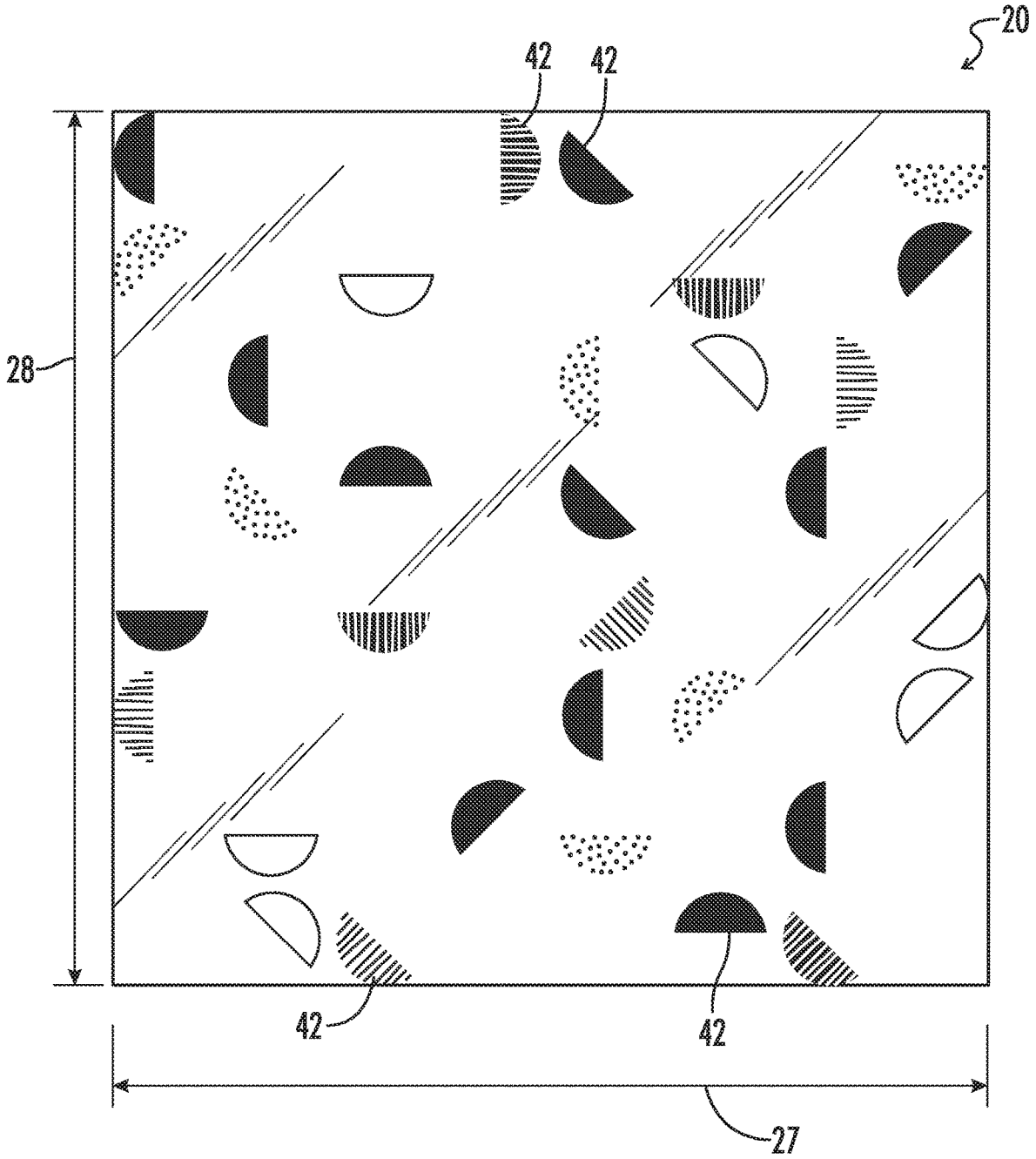
FIG. 6 illustrates a top plan view of a stamp of one embodiment of the present invention.
Figure 7:
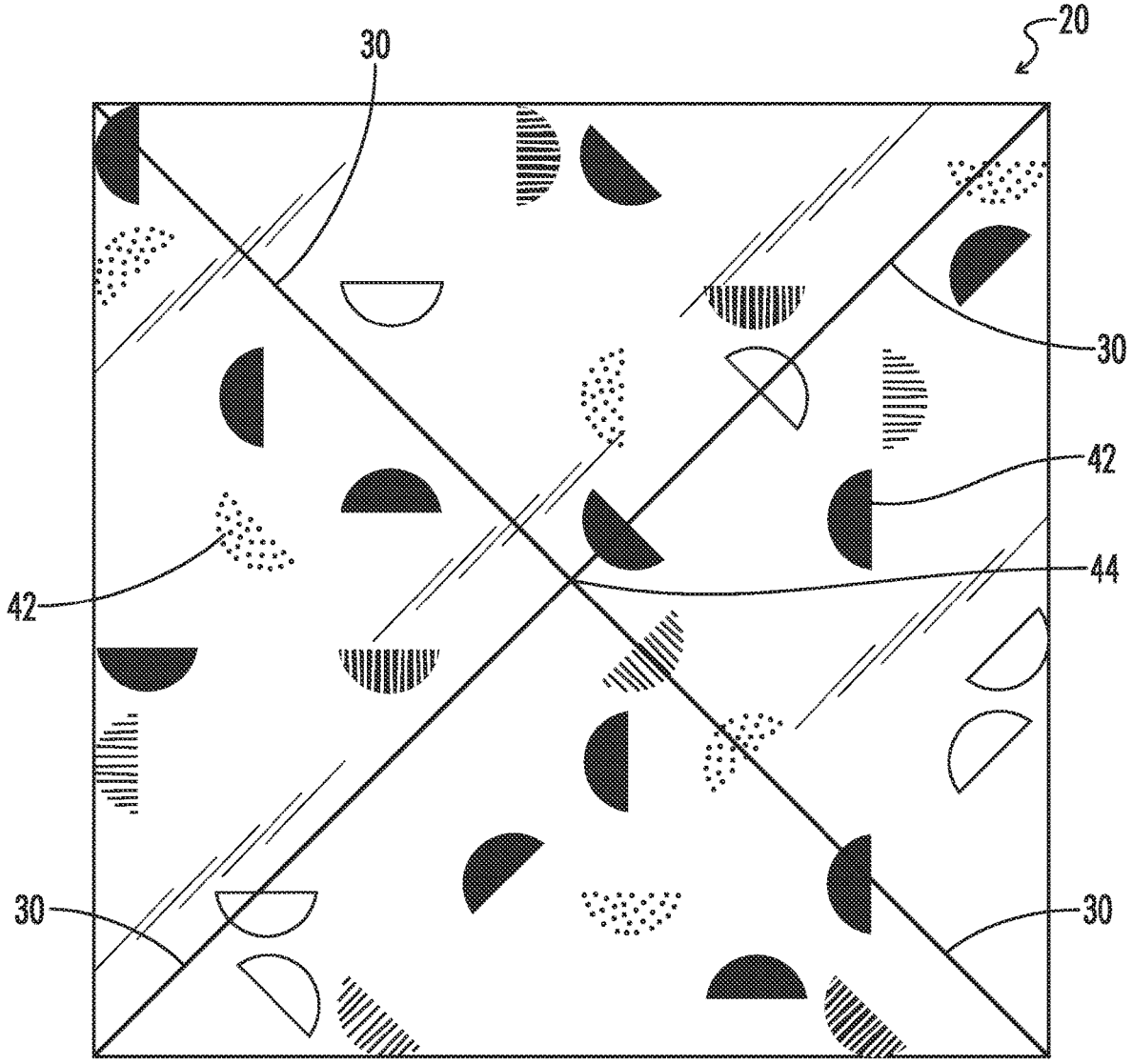
FIG. 7 illustrates a top plan view of the stamp of FIG. 6 with an X drawn in permanent marker on the stamp using the guide card of FIG. 5.
Figure 8:
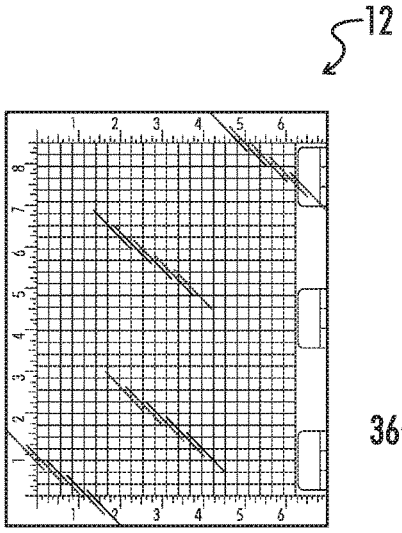
FIG. 8 illustrates a top plan view of the stamp platform of FIG. 1 with the stamp platform in the closed position.
Figure 24:
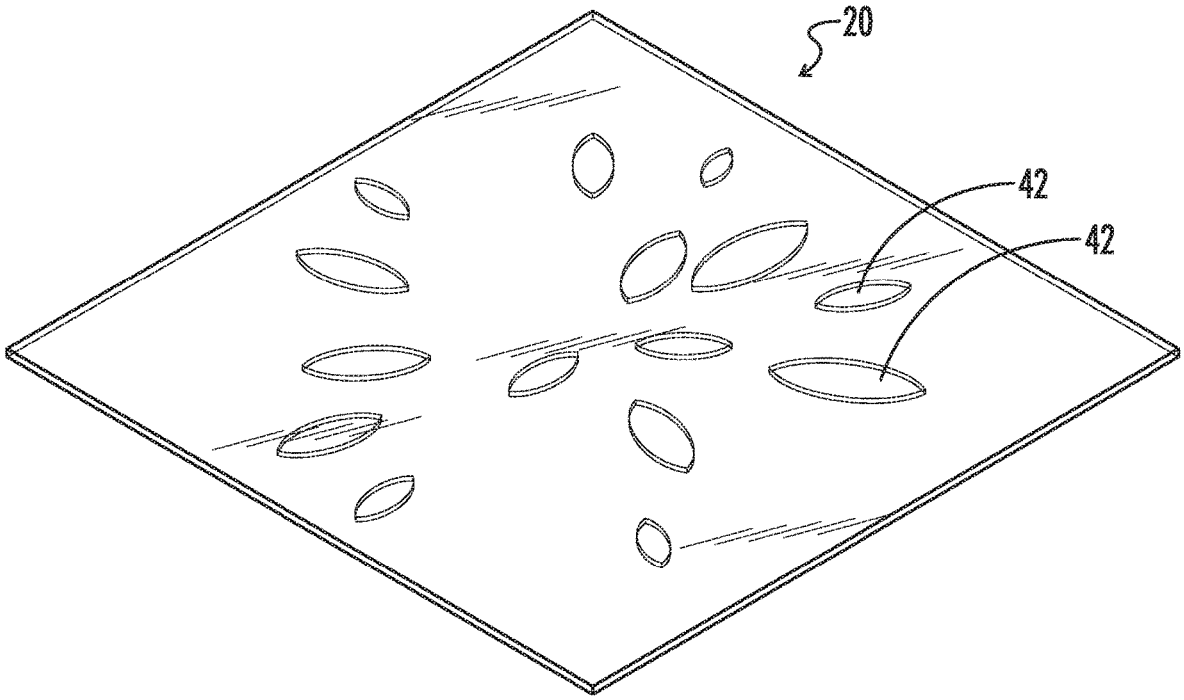
FIG. 24 illustrates a side perspective view of a stamp of another embodiment of the present invention.
Figure 25:
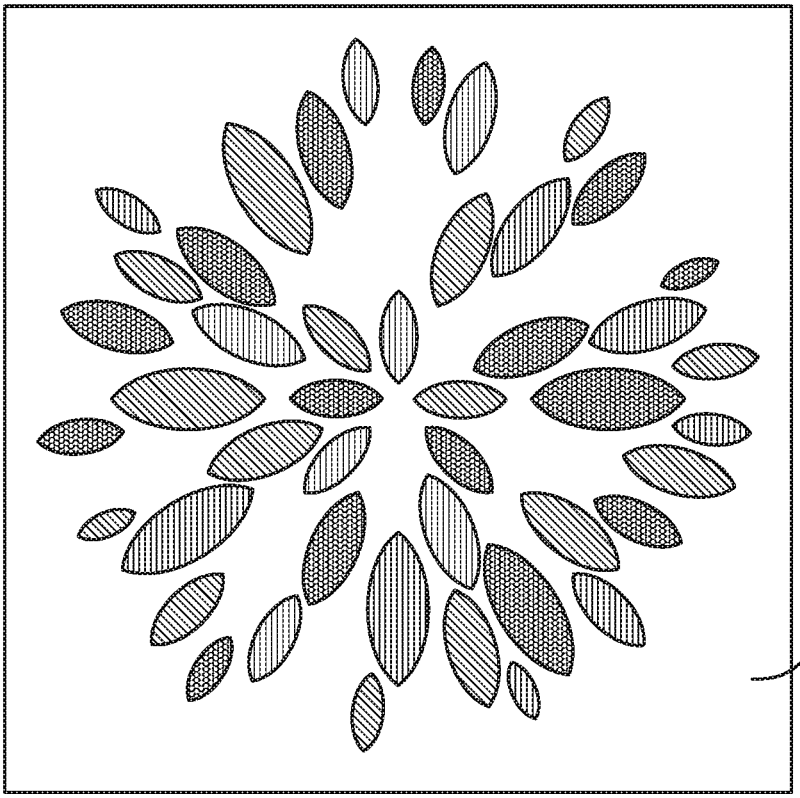
FIG. 25 illustrates a top plan view of stamped cardstock prepared by the method of the present invention using the stamp of FIG. 24 and rotating the cardstock and jig three times 90 degrees on the stamp platform.
Figure 26:
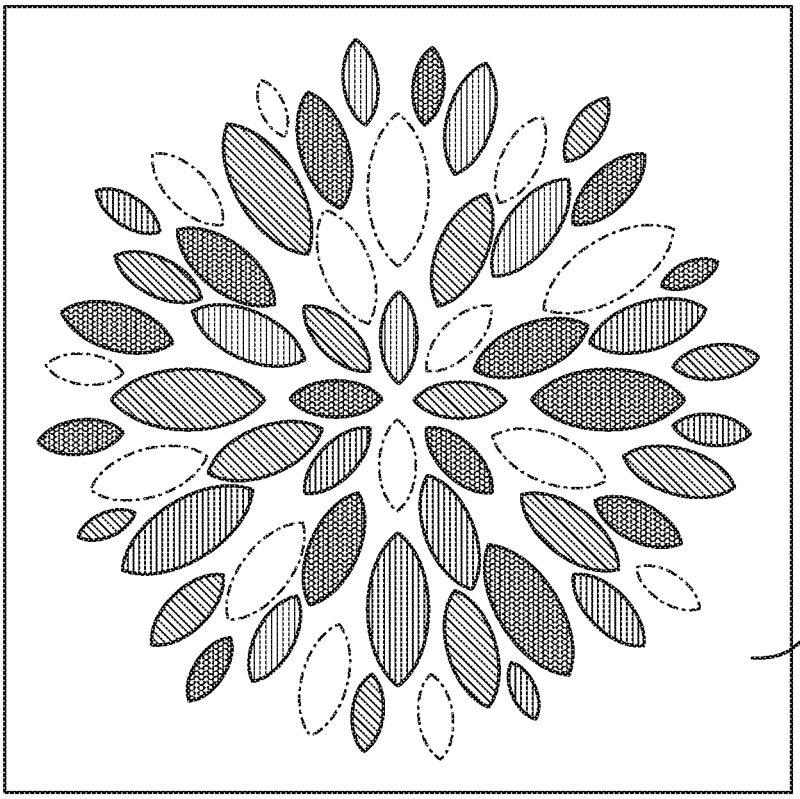
FIG. 26 illustrates a top plan view of the stamped cardstock of FIG. 25.
Figure 27:
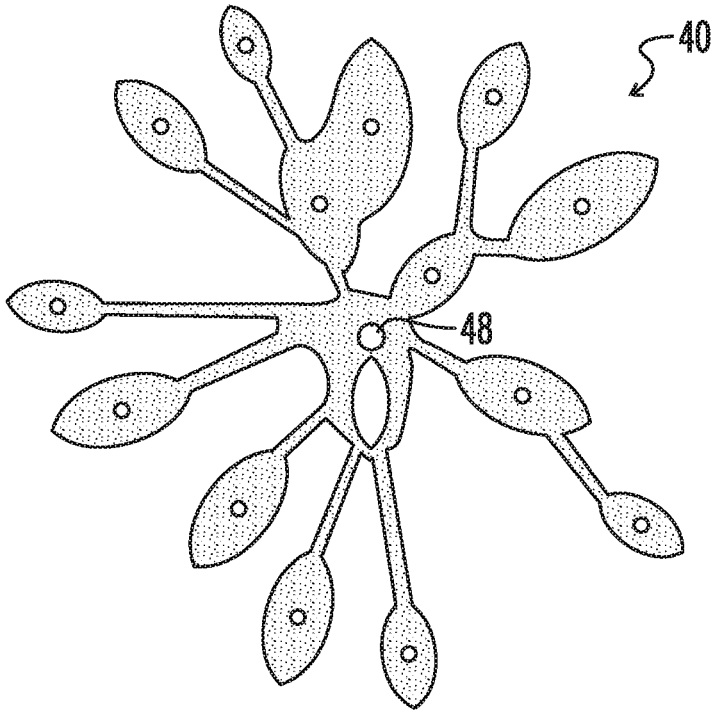
FIG. 27 illustrates a top plan view of an embossing tool of one embodiment of the present invention.
Figure 28:
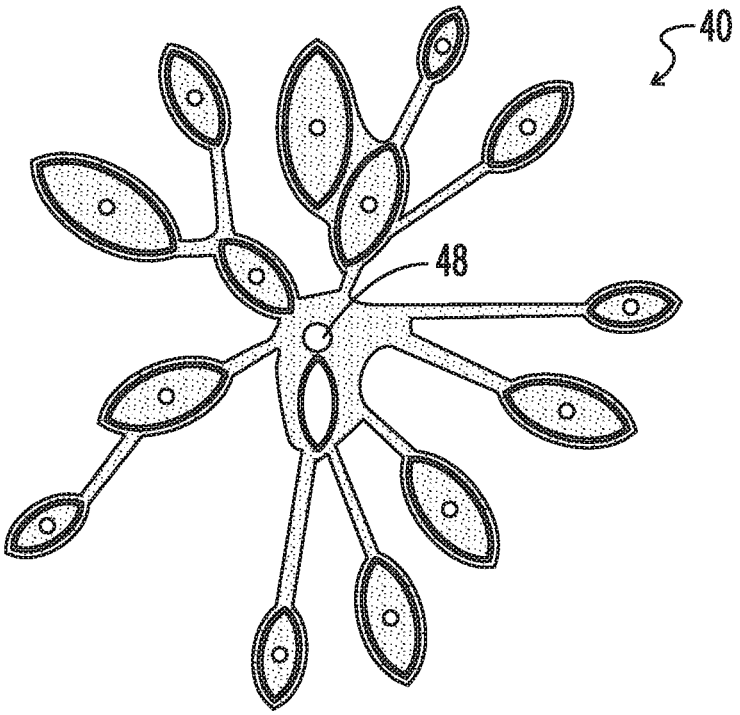
FIG. 28 illustrates a bottom plan view of the embossing tool of FIG. 27.

Optionally, the stamp 20 is provided by the manufacturer with a design pattern 42, and the user creates the alignment pattern 30. For example, the packaging accompanying the stamp 20 may include a guide card 50 comprising a design pattern 54 and an alignment pattern 52 comprising a plurality of intersecting lines (see FIGS. 4 and 5 for two different styles of guide cards 50), and the user may place the stamp 20 over the guide card 50 so that stamp design pattern 42 aligns with the guide card design pattern 54, and then the user may draw the alignment pattern 30 on the stamp 20 using for example a black permanent marker and a ruler, and the guide card alignment pattern 54 as a guide, as shown in FIG. 7. Preferably, the alignment pattern 30 is opaque (e.g., a black or red X). The design pattern 42 may be any suitable design, including without limitation semi-circles (as shown in FIG. 6), triangles, various shapes such as bars, dots, hearts, and ovals that radiate from the center 44 (as shown in FIG. 24), as well as textual material.

Figure 11:
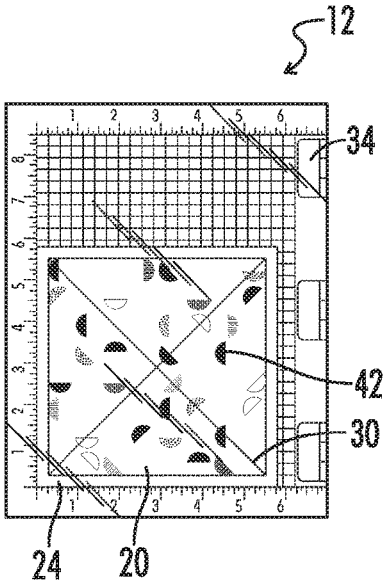
FIG. 11 illustrates a top plan view of the stamp platform of FIG. 10 with the stamp platform in the closed position, the jig on the workspace and the stamp of FIG. 10 placed on the jig.
Figure 12:
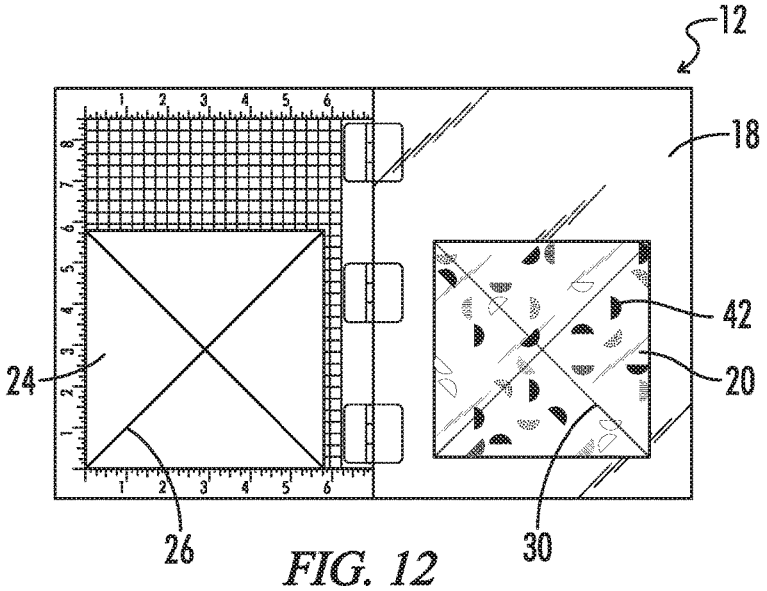
FIG. 12 illustrates a top plan view of the stamp platform of FIG. 11 with the stamp platform in the open position, the jig on the workspace and the stamp of FIG. 11 removably attached to the interior surface of the lid.

Optionally, the stamp 20 is removably attached to the lid 16 by placing the stamp 20 on the jig 24 so that the alignment pattern 30 on the stamp 20 aligns with the alignment pattern 26 on the jig 24 (as shown in FIG. 10), pivoting the lid 16 towards the workspace 22 (as shown in FIG. 11), and then pivoting the lid 16 away from the workspace 22 to attach the stamp 20 to the lid 16 (as shown in FIG. 12) (i.e., using the lid 16 to pick up the stamp 20).

Optionally, the stamp 20 has a lengthwise and widthwise center 44 and the plurality of lines of the stamp alignment pattern 30 intersect at approximately (preferably exactly) the lengthwise and widthwise center 44.

Figure 29:
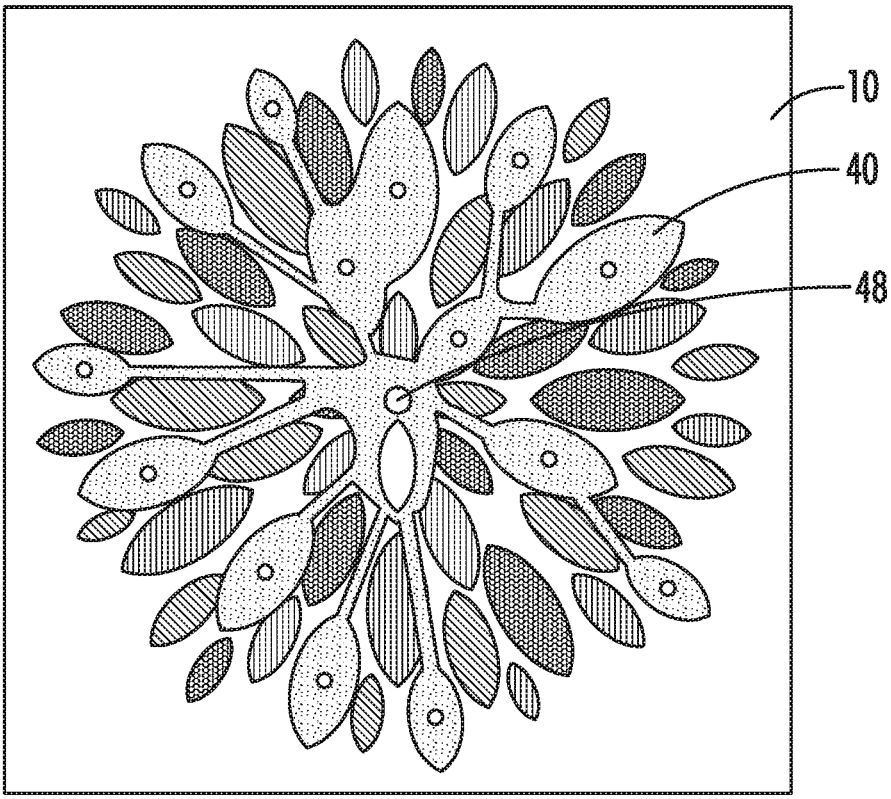
FIG. 29 illustrates a top plan view of the embossing tool of FIG. 27 placed on the cardstock of FIG. 25.
Figure 30:
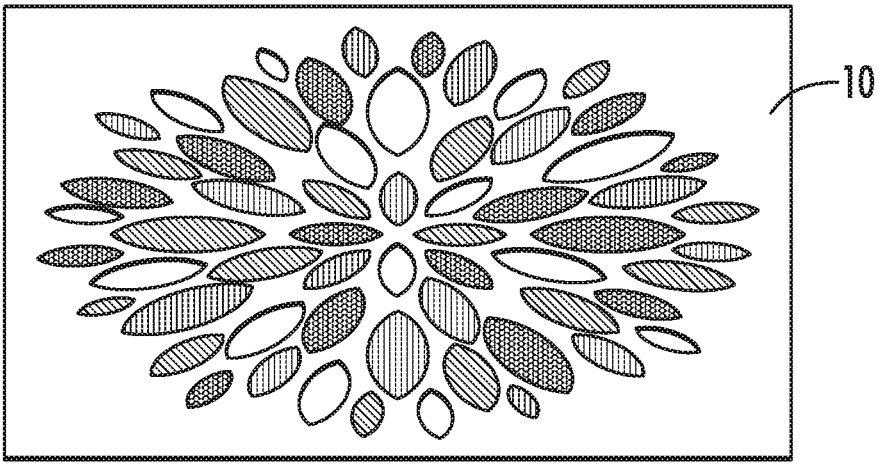
FIG. 30 illustrates a top plan view of the cardstock of FIG. 25 after placing the embossing tool on the cardstock as shown in FIG. 29 and inserting the cardstock and embossing tool through a roller.
Figure 31:
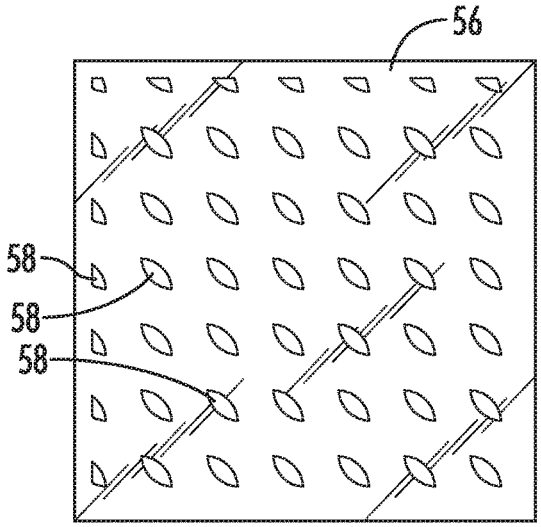
FIG. 31 illustrates a top plan view of a stencil for use in one embodiment of the present invention.
Figure 32:
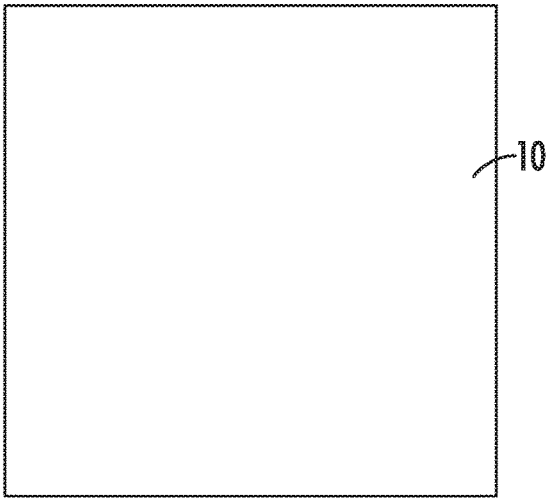
FIG. 32 illustrates a top plan view of a substrate for use with the stencil of FIG. 31.
Figure 33:
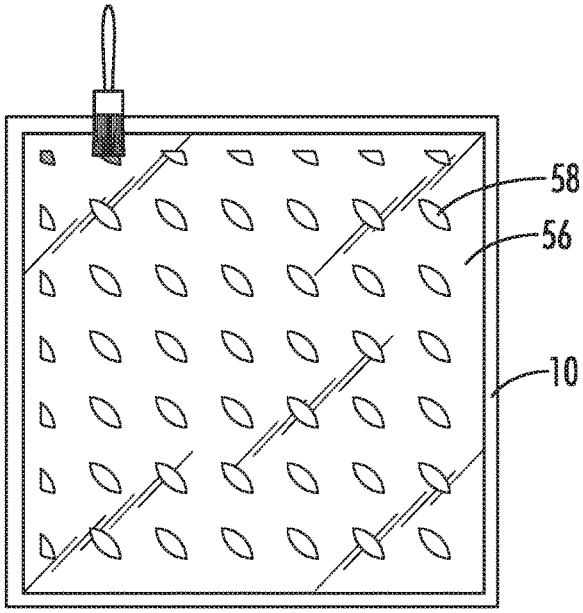
FIG. 33 illustrates a top plan view of ink being applied over the stencil of FIG. 31 with the substrate of FIG. 32 below the stencil.
Figure 34:
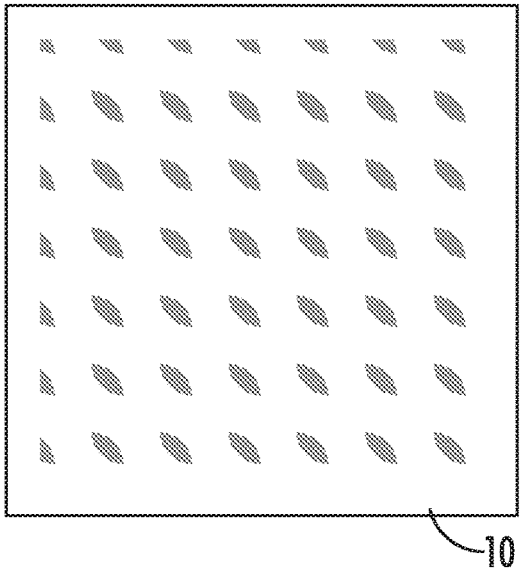
FIG. 34 illustrates a top plan view of the substrate of FIG. 33 after the ink has been applied.
Figure 35:
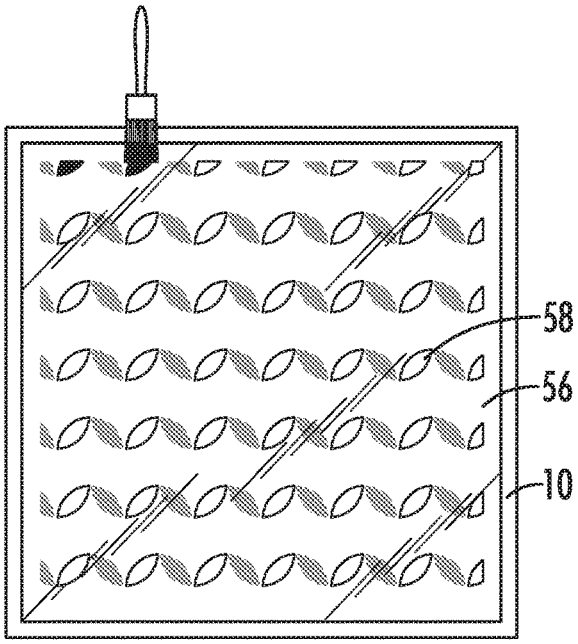
FIG. 35 illustrates a top plan view of ink being applied over the stencil of FIG. 31 with the substrate of FIG. 34 below the stencil; as compared to FIG. 33, the stencil has been rotated 90 degrees.
Figure 36:
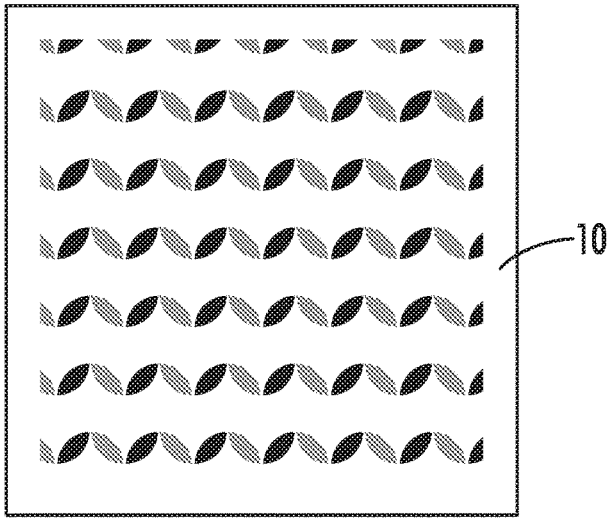
FIG. 36 illustrates a top plan view of the substrate of FIG. 35 after the ink has been applied.
Figure 37:
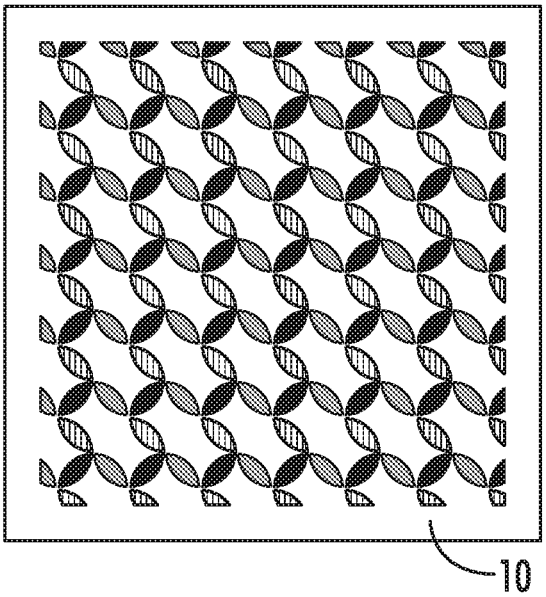
FIG. 37 illustrates a top plan view of the substrate of FIG. 35 after a second round of rotation and inking.
Figure 38:
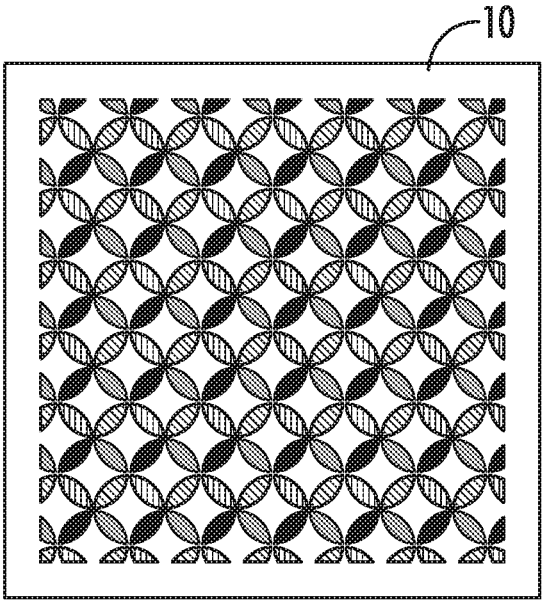
FIG. 38 illustrates a top plan view of the substrate of FIG. 35 after a third round of rotations and inking.

Optionally, instead of using a stamp 20 for all three rotations, the user may use embossing for one or more of the rotations. For example, the method may include placing an embossing tool 40 on the stampable substrate 10 (as shown in FIG. 29) and placing the stampable substrate 10 and the embossing tool 40 through a roller to create the design shown in FIG. 30. Optionally, the embossing tool 40 has a lengthwise and widthwise center and the embossing tool 40 has a center hole 48 located approximately (preferably exactly) in the lengthwise and widthwise center to facilitate alignment of the embossing tool 40, as shown in FIG. 29.

In other embodiments, as opposed to a stamp 20, the present disclosure may use a stencil 56, as shown in FIGS. 31-39. The method of using a stencil 56 may include for example a) providing a stencil 56, which has stencil holes 58, and a substrate 10 (e.g., a paper-based material) below the stencil 56; b) applying ink over the stencil 56 (e.g., using a sponge, brayer or spritzing tool) to mark the substrate 10 with ink (see FIGS. 32 and 33); c) rotating the stencil 56 relative to the substrate 10 (e.g., 90 degrees) (see FIG. 34); and d) applying ink (e.g., a different colored ink) over the stencil 56 (see FIG. 35). The stencil 56 may then rotated once again and a different colored ink may be applied over the stencil 56 to give the image shown in FIG. 36. The aforementioned of using the stencil 56, may involve using a stamp platform 12 with the lid 16 open during the entire process (steps a-d) and placing the stencil 56 and stampable substrate 10 against the raised sides 36.

| Part List | |
|---|---|
| stamp able substrate | 10 |
| stamp platform | 12 |
| base | 14 |
| lid | 16 |
| lid interior surface | 18 |
| stamp | 20 |
| workspace | 22 |
| jig | 24 |
| jig alignment pattern | 26 |
| stamp width | 27 |
| stamp length | 28 |
| stamp alignment pattern | 30 |
| ink pad | 32 |
| hinge | 34 |
| raised sides | 36 |
| cleaning cloth | 38 |
| embossing tool | 40 |
| stamp design pattern | 42 |
| stamp center | 44 |
| jig center | 46 |
| embossing tool center hole | 48 |
| guide card | 50 |
| guide card alignment pattern | 52 |
| guide card design pattern | 54 |
| stencil | 56 |
| stencil holes | 58 |
| widthwise and lengthwise center of cardstock | 60 |

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A method of stamping a stampable substrate comprising the steps of:

a) providing a stamp platform comprising a base and a lid pivotably attached to the base and configured to pivot toward and away from the base, the lid comprising an interior surface configured to receive a stamp and the base comprising a workspace configured to support a stamp able substrate;

b) providing a guide card comprising a lengthwise and widthwise center, and a plurality of lines intersecting at approximately the lengthwise and widthwise center;

c) placing the guide card in the stamp platform and positioning at least one stamp on the guide card;

d) closing the lid to attach the stamp to the interior surface of the lid;

e) inking the stamp with a first color of ink;

f) moving the lid and attached stamp towards the workspace and a stampable substrate supported by the workspace to mark the stampable substrate with the stamp;

g) rotating the stampable substrate on the workspace without rotating the stamp; and h) moving the lid and attached stamp again towards the workspace and the stampable substrate to mark the rotated stampable substrate with the stamp.

2. The method of claim 1 wherein the method further comprises, between steps f) and h), cleaning the stamp and then inking the stamp with a different color of ink as compared to step e).

3. The method of claim 1 wherein the stamp platform comprises at least two raised sides bordering and extending above the workspace, and step c) comprises placing the guide card against the raised sides.

4. The method of claim 1 wherein the stamp is generally clear.

5. The method of claim 1 wherein the method further comprises, after step h), repeating steps g) and h) two more times, cleaning the stamp and then inking the stamp with a different color of ink as compared to step e), then repeating step f), then repeating steps g) and h) three more times.

6. The method of claim 1 wherein the plurality of lines on the guide card are perpendicular.

7. The method of claim 1 wherein the guide card comprises two lines intersecting at approximately the lengthwise and widthwise center and dividing the guide card into four equally-sized regions.

8. The method of claim 7 wherein each equally-sized region comprises a plurality of shapes.

9. The method of marking a substrate with a stencil comprising the steps of: a) providing a substrate; b) placing a stencil comprising stencil holes over the substrate; b) applying a first colored ink through the stencil holes to mark the substrate with the first colored ink; c) rotating the stencil 90 degrees relative to the substrate; and d) applying a second colored ink through the stencil holes to mark the substrate with the second colored ink.

10. The method of claim 9 wherein the first colored ink is different than the second colored ink.

* * * * *